United States Patent [19]

Bither

[11] Patent Number: 4,680,223

[45] Date of Patent: Jul. 14, 1987

[54] FIBROUS INNER WEB FOR SHEET VINYL FLOORING GOODS

[75] Inventor: Peter G. Bither, New Castle County, Del.

[73] Assignee: Hercules Incorporated, Wilmington, Del.

[21] Appl. No.: 801,106

[22] Filed: Nov. 22, 1985

[51] Int. Cl.[4] ..... D04H 1/08

[52] U.S. Cl. ..... 428/280; 162/135; 162/145; 162/164 EP; 162/164 N; 162/168 N; 162/168 NA; 428/281; 428/288; 523/206

[58] Field of Search ..... 162/135, 145, 146, 158, 162/156, 164 R, 164 EP, 168 N, 168 NA, 181 R, 187 R; 428/95, 280, 281, 288; 523/206

[56] References Cited

U.S. PATENT DOCUMENTS

| | | | |
|---|---|---|---|
| T103,903 | 2/1984 | Campbell et al. | 523/206 |
| 4,245,689 | 1/1981 | Grard et al. | 162/134 |
| 4,269,657 | 5/1981 | Gomez et al. | 162/135 |
| 4,274,916 | 6/1981 | Grose | 162/145 |
| 4,373,992 | 2/1983 | Bondoc | 162/145 |

*Primary Examiner*—Marion C. McCamish

*Attorney, Agent, or Firm*—Joanne W. Patterson

[57] ABSTRACT

A fibrous web is prepared from a composition comprising woodpulp, glass fibers, polyolefin pulp containing carboxylic functionality, an inorganic filler, a polymeric binder, polyolefin pulp devoid of carboxylic functionality, if desired, and polyvinyl chloride, if desired. The fibrous web is useful as an inner layer in a multi-layer sheet floor covering material.

9 Claims, No Drawings

FIBROUS INNER WEB FOR SHEET VINYL FLOORING GOODS

FIELD OF THE INVENTION

This invention relates to a novel fibrous web for use as a reinforcing inner layer in a multi-layer vinyl sheet floor covering material. Particularly, this invention relates to a novel fibrous web adapted for use in the manufacture of what is referred to in the art as "lay flat-stay flat" vinyl floor covering.

BACKGROUND OF THE INVENTION

A recent innovation in the production of decorative sheet type vinyl floor covering is the so-called "lay flat-stay flat" flooring. Presently available flooring of this type contains an inner web of staple glass fibers bonded with a thermoset resin, usually a urea-formaldehyde resin. This glass fiber web is coated on both sides, e.g., with a filled polyvinyl chloride plastisol, before additional layers are applied to produce a floor covering material. This flooring material is superior in flatness to conventional vinyl floor coverings produced by one side coating of backing felts.

Flooring products containing these thermoset resin-impregnated glass fiber inner webs have a tendency to buckle, especially when installed over certain substrates such as wood flooring. Wood flooring changes in dimensions with changes in relative humidity, and the flooring material containing the thermoset resin-impregnated glass fiber inner web is too stiff to move with the substrate. A more flexible floor covering capable of changing dimensions at the same rate as the substrate to which it is applied would not have such a tendency to buckle.

SUMMARY OF THE INVENTION

In accordance with this invention there is provided a fibrous inner web adapted for use in the manufacture of "lay-flat, stay-flat" sheet flooring incorporating therein polyolefin pulp containing carboxylic functionality.

The fibrous inner web of this invention is more flexible than thermoset resin-impregnated glass fiber inner webs, has good internal bond strength and is capable of changing dimensions at the same rate as the substrate to which it is applied. A further advantage of the inner web of this invention is that it can be produced on conventional papermaking equipment and subsequently processed in the same manner as conventional felt-backed flooring products.

The fibrous web-forming composition of this invention comprises (a) from about 4% to about 15% woodpulp fibers, (b) from about 5% to about 10% glass fibers, (c) from about 4% to about 15% polyolefin pulp containing carboxylic functionality, (d) from 0 to about 5% polyolefin pulp devoid of carboxylic functionality, (e) from about 30% to about 65% inorganic filler, (f) from about 10% to about 15% thermoplastic polymeric binder, other than polyvinyl chloride, and (g) from 0 to about 20% polyvinyl chloride, all percentages being by weight based on the total weight of the composition.

Papermaking additives such as retention aids, wet and dry strength agents, and antioxidants may also be added to the composition, if desired.

DETAILED DESCRIPTION OF THE INVENTION

The fibers contained in the fibrous web of the present invention are derived from (1) polyolefin pulp containing carboxylic functionality, or a mixture of such a pulp with polyolefin pulp devoid of carboxylic functionality, (2) glass fibers and (3) woodpulp fibers. The polyolefin pulp devoid of carboxylic functionality is hereinafter referred to as conventional polyolefin pulp.

Conventional polyolefin pulps are very fine, highly-branched, discontinuous fibers made from polyolefins such as polyethylene, polypropylene, an ethylene-propylene copolymer or a mixture of any of these polyolefin materials. Such pulps are known to the art, as are their methods of manufacture. See, e.g., "Pulp, Synthetic", Kirk-Othmer, *Encyclopedia of Chemical Technology*, 3rd. ed. (New York, 1982) Vol. 19, pp. 420–435, which is incorporated herein by reference.

As disclosed in U.S Pat. No. 4,154,647, the disclosure of which is incorporated herein by reference, the polyolefin pulp containing carboxylic functionality used in the present invention may be (1) a polyolefin pulp containing carboxyl groups that have been introduced into the polymer molecule by grafting the polyolefin with acrylic acid, methacrylic acid, maleic anhydride or mixtures thereof, (2) a polyolefin pulp containing carboxyl groups that have been introduced into the polymer molecule by oxidizing the polyolefin with oxygen or ozone, or (3) a polyolefin pulp prepared from a blend of a polyolefin and an anionic polymer containing carboxylic functionality. The polyolefin may be polyethylene, polypropylene, an ethylene-propylene copolymer or a mixture of any of these polyolefins.

When the polyolefin pulp containing carboxylic functionality is a pulp prepared from a blend of a polyolefin and an anionic polymer containing carboxylic functionality, the latter component may be the same as (1) or (2) above, a copolymer of any one of ethylene, propylene, styrene, alphamethylstyrene or mixtures thereof with any one of acrylic acid, methacrylic acid, maleic anhydride or mixtures thereof; or mixtures of any these anionic polymer components.

Bonding between the carboxyl groups of the polyolefin pulp and the glass fibers as well as with the —OH groups of the cellulose in the woodpulp is believed to increase internal cohesion in the finished fibrous web.

In this specification, all parts and percentages are by weight unless otherwise specified.

The amount of polyolefin pulp containing carboxylic functionality present is from about 4% to about 15% by weight, based on the total weight of the fibrous web-forming composition. Up to about 5% conventional polyolefin pulp may also be added. If used, from about 1% to about 5% is preferred.

The glass fibers used in the fibrous web of the present invention have an average length of about 1/16 to about ¼ inch. A length of about ⅛ inch is preferred. The average diameter of the glass fiber is from about 6 to about 11 microns. A diameter of about 6 to about 8 microns is preferred.

The amount of glass fibers present is from about 5% to about 10% by weight, based on the total weight of the fibrous web-forming composition.

The wood pulp used in the fibrous web may be any of the pulps commonly used in the manufacture of paper. Bleached softwood kraft is preferred because of its strength characteristics.

The amount of woodpulp fibers present is from about 4% to about 15% by weight, based on the total weight of the fibrous web-forming composition.

If desired, small amounts of other fibers that are dispersible in water, especially nylon fibers and polyester fibers such as polyethylene terephthalate fibers may be added to the fiber furnish to increase the tear resistance of the web and the flexibility of the finished floor covering product.

The web-forming composition also contains a thermoplastic polymeric binder. The binder is used to improve the flexibility, internal cohesion and dimensional stability of the web in the wet and dry state and the resistance to tearing of the finished product. Suitable binder materials include styrene-butadiene rubber (SBR), neoprene, acrylic resins, acrylonitrile-butadiene rubber, polybutadiene, and polyvinyl acetate. Styrene-butadiene rubber is preferred. These binders are commercially available as latices and are used in this form in the preparation of the fibrous webs of this invention.

The amount of thermoplastic polymeric binder present on a dry basis is from about 10% to about 15% by weight, based on the total weight of the fibrous web-forming composition.

It may be advantageous to add polyvinyl chloride, either in the form of a latex or in dry form, to the web-forming composition prior to sheet formation. This polyvinyl chloride is believed to act as a "bridge" between the inner web and the polyvinyl chloride in the layers typically applied on either side of the inner web, thereby preventing delamination within the inner layer. If used, the polyvinyl chloride will be employed in an amount of from about 5% to about 20% by weight, on a dry basis, based on the total weight of the fibrous web-forming composition.

The inorganic filler may be any wet end filler commonly used in the paper industry. Talc, clay and calcium carbonate are particularly suitable.

The amount of inorganic filler is from about 30% to about 65% by weight, based on the total weight of the fibrous web-forming composition.

The average thickness of the fibrous web is normally from about 8 to about 22 mils, typically about 18 mils, depending upon the nature of the floor covering material into which it is subsequently incorporated.

Additional components such as materials to enhance the deposition and retention of the binder on the fiber furnish, wet and dry strength agents and antioxidants may also be included in the web-forming composition, if desired.

Thus it may be desirable to incorporate into the composition prior to sheet formation a wet strength resin used in the manufacture of paper, e.g., a cationic poly(N-methyldiallylamine)/epichlorohydrin resin having a viscosity of 30–70 cps. at 25° C. If used, it will be employed in an amount of from about 0.5 to about 4% by weight based on the total weight of the fibrous web-forming composition.

It may also be desirable to incorporate into the composition prior to sheet formation a dry strength agent used in the manufacture of paper, e.g., an anionic polyacrylamide resin having a viscosity of 1000–1500 cps at 25° C. If used, it will be employed in an amount of from about 0.5% to about 5% by weight based on the total weight of the fibrous web-forming composition.

The fibrous web of the present invention is incorporated as a reinforcing inner layer in a resilient floor covering product by conventional techniques well known to those skilled in the art. Typically one side of the fibrous inner web is coated with a layer of foamable polyvinyl chloride plastisol about 30 mils thick, which in turn is coated with a 10 mil thick wear layer of polyurethane or a clear coat of polyvinyl chloride. The other side of the fibrous inner web is typically coated with a layer of filled polyvinyl chloride plastisol about 12 mils thick.

Additional steps in the production of the finished floor covering product such as heating the foamable composition to gel it, fusing and foaming the foamable layer, printing, embossing, etc., are well known to those skilled in the art.

EXAMPLE A

A suitable polyolefin pulp containing carboxylic functionality is prepared as follows.

Crystalline polypropylene (200 parts) grafted with three percent by weight of maleic anhydride is charged to a closed autoclave along with 2672 parts of pentane solvent. The contents of the autoclave are stirred and heated to 170° C. at which point the vapor pressure in the autoclave is raised to 1500 p.s.i. by introduction of nitrogen. The resulting solution is spurted from the autoclave into the atmosphere through an orifice having a diameter of one millimeter and a length of one millimeter, resulting in evaporation of the pentane solvent and formation of the desired pulp product.

EXAMPLE B

Another representative polyolefin pulp containing carboxylic functionality is prepared as follows.

Ninety parts of high density polyethylene (melt index 5.5–6.5 at 190° C.) and 10 parts of an ethylene-acrylic acid copolymer (92:8 ethylene:acrylic acid, melt index 5.3) are charged to a closed autoclave along with 400 parts of pentane as the solvent. The contents of the autoclave are stirred and heated to 193° C. at which point the vapor pressure in the autoclave is raised to 1650 psi by the introduction of nitrogen. The resulting solution is spurted from the autoclave into the atmosphere through an orifice having a diameter of one millimeter and a length of one millimeter, resulting in evaporation of the pentane solvent and formation of the desired pulp product. The pulp is then disc refined for six minutes in a Sprout Waldron disc refiner at 1.5% consistency in water.

EXAMPLE 1

Bleached softwood kraft (4 parts), 4 parts polypropylene pulp grafted with maleic anhydride prepared as described in Example A, 4 parts polyethylene pulp and 3.2 parts anionic polyacrylamide dry-strength resin (viscosity 1000–1500 cps at 25° C.) are blended with 62 parts talc in a hydropulper at a consistency of about 2%. The mixture is then run through a double disc refiner to reduce the Canadian Standard Freeness (CSF) to 500.

Glass fibers ⅛ inch long and 7.6 microns in diameter (8 parts) are added at the dump chest and the mixture is allowed to mix for three to five minutes. Cationic retention aid (0.15%) is added to prefloc the filler. Styrene-butadiene latex binder (12.5 parts) is then added, followed by 2.0 parts cationic poly(N-methyldiallylamine)/epichlorohydrin wet strength resin (viscosity 30–70 cps at 25° C. ).

Anionic flocculant (0.05%) is added to the stock at head box consistency just ahead of the machine to control the drainage and retention of the web.

The slurry is formed into a sheet on a Fourdrinier wire and the sheet is then passed through conventional presses and dried in the multicylinder drying section of a paperboard machine.

The sheet thus formed was subjected to the following measurements: tensile strength at 22° C. in both the machine and cross directions; tensile strength at 177° C. in the machine direction; Taber stiffness; per cent elongation at 177° C. in the machine direction (higher values indicate greater flexibility); and % change in dimensions after soaking in water for 72 hours (low values are desirable). A negative value for percent change in dimensions indicates shrinkage. A high value for the tensile strength at 177° C. indicates that the sheet has sufficient hot tensile to perform adequately in subsequent coating steps during processing into the finished floor covering material.

A comparison of the properities of (1) a fibrous web prepared from compositions illustrative of this invention and (2) a glass fiber inner web impregnated with a thermoset urea-formaldehyde resin used in presently available flooring of the "lay flat-stay flat" type, is shown in Table 2.

EXAMPLE 2

The components of the web-forming composition are the same as in Example 1. The amount of each component used is shown in Table 1. The components are combined and formed into a sheet as described in Example 1.

The results of the measurements of physical properties are given in Table 2.

EXAMPLE 3

The components of the web-forming composition and the amounts of each are shown in Table 1. The dry polyvinyl chloride (PVC) is added at the dump chest along with the SBR latex binder. The components are combined and formed into a sheet as described in Example 1.

The results of the measurements of physical properties are given in Table 2.

EXAMPLE 4

The components of the web-forming composition and the amounts of each are shown in Table 1. The polyethylene terephthalate fibers are added to the mixture in the hydropulper. The polyvinyl chloride latex is added at the dump chest along with the SBR latex. The components are combined and formed into a sheet as described in Example 1.

The results of the measurements of physical properties are given in Table 2.

TABLE 1

| | Example 1 (Parts by weight) | Example 2 (Parts by weight) | Example 3 (Parts by weight) | Example 4 (Parts by weight) |
|---|---|---|---|---|
| Carboxylated polypropylene pulp[1] | 4 | 4 | 4 | — |
| Conventional polyethylene pulp | 4 | 4 | 4 | — |
| Carboxylated polyethylene pulp[2] | — | — | — | 10 |
| Woodpulp | 4 | 4 | 4 | 15 |
| Glass fiber (⅛") | 8 | 7 | 7 | 5 |
| Polyester fiber (⅛", 3 denier) | — | — | — | 5 |
| Talc | 62 | 64 | 44 | — |
| Clay | — | — | — | 33 |
| SBR Latex | 12.5 | 12.5 | 12.5 | 10 |
| PVC Latex | — | — | — | 15 |
| Dry PVC | — | — | 20 | — |
| Dry-strength resin[3] | 3.2 | 2.3 | 2.3 | 4 |
| Wet-strength resin[4] | 2.0 | 1.8 | 1.8 | 3 |

[1]Polypropylene grafted with maleic anhydride
[2]A pulp prepared from a blend of high density polyethylene and an ethylene/acrylic acid copolymer
[3]Anionic polyacrylamide resin having a viscosity at 25° C. of 1000–1500 cps.
[4]Cationic poly(N—methyldiallylamine)/epichlorohydrin resin having a viscosity at 25° C. of 30–70 cps.

TABLE 2

| | Resin-Impregnated Glass Fiber Web* | Example 1 | Example 2 | Example 3 | Example 4 |
|---|---|---|---|---|---|
| Basis Wt. (lbs/3000) | 31.4 | 239 | 262 | 264 | 134 |
| Caliper (mils) | 13.3 | 17.6 | 17.7 | 16.7 | 14.1 |
| Sp. Gr. | 0.151 | 0.867 | 0.946 | 1.013 | 0.608 |
| Tensile strength at 22° C. (lbs/in) | | | | | |
| MD | 12.2 | 54 | 39 | 30 | 40 |
| CD | 16.0 | 32 | 23 | 20 | 20 |
| Tensile strength at 177° C. (lbs/in) MD | 8.0 | 19 | 19 | 11 | 8 |
| Taber stiffness (gm-cm) MD | 14 | 57 | 41 | 46 | 31 |
| % Elongation @ 177° C. MD | 1.4 | 1.2 | 1.8 | 1.8 | 1.0 |
| % Change in Dimensions** MD | 0 | .04 | −.02 | 0 | .09 |

*The resin is a thermoset urea-formaldehyde resin
**After soaking in water for 72 hours

What I claim and desire to protect by letters patent is:

1. A fibrous web-forming composition comprising
(a) from about 4% to about 15% woodpulp,
(b) from about 5% to about 10% glass fibers,
(c) from about 4% to about 15% polyolefin pulp containing carboxylic functionality,
(d) from 0 to about 5% polyolefin pulp devoid of carboxylic functionality,
(e) from about 30% to about 65% inorganic filler,
(f) from about 10% to about 15% thermoplastic polymeric binder, other than polyvinyl chloride, and
(g) from 0 to about 20% polyvinyl chloride, all percentages being by weight based on the total weight of the composition.

2. The composition of claim 1 wherein the polyolefin pulp containing carboxylic functionality is a pulp prepared from a blend of high density polyethylene and an ethylene/acrylic acid copolymer.

3. The composition of claim 1 wherein the polyolefin pulp containing carboxylic functionality is a pulp prepared from polypropylene grafted with maleic anhydride.

4. A fibrous web, useful as an inner layer in a multilayer sheet floor covering material, prepared from a composition comprising (a) from about 4% to about 15% woodpulp,
(b) from about 5% to about 10% glass fibers,
(c) from about 4% to about 15% polyolefin pulp containing carboxylic functionality,
(d) from 0 to about 5% polyolefin pulp devoid of carboxylic functionality,
(e) from about 30% to about 65% inorganic filler,
(f) from about 10% to about 15% thermoplastic polymeric binder, other than polyvinyl chloride, and
(g) from 0 to about 20% polyvinyl chloride, all percentages being by weight based on the total weight of the composition.

5. The fibrous web of claim 4 wherein the polyolefin pulp having carboxylic functionality is a pulp prepared from a blend of high density polyethylene and an ethylene/acrylic acid copolymer.

6. A sheet floor covering material comprising a top layer, a bottom layer, and a plurality of inner layers, at least one of said inner layers comprising the fibrous web of claim 5.

7. The fibrous web of claim 4 wherein the polyolefin pulp having carboxylic functionality is a pulp prepared from polypropylene grafted with maleic anhydride.

8. A sheet floor covering material comprising a top layer, a bottom layer, and a plurality of inner layers, at least one of said inner layers comprising the fibrous web of claim 7.

9. A sheet floor covering material comprising a top layer, a bottom layer, and a plurality of inner layers, at least one of said inner layers comprising the fibrous web of claim 4.

* * * * *